United States Patent [19]

Aguirre

[11] Patent Number: 4,513,935

[45] Date of Patent: Apr. 30, 1985

[54] NURSING BOTTLE SUPPORT

[76] Inventor: Everado M. Aguirre, LaPerpetua 1688 Del Country S.H.J., Guadalajara 2, Jalisco, Mexico

[21] Appl. No.: 433,820

[22] Filed: Feb. 28, 1983

[30] Foreign Application Priority Data

Jan. 4, 1982 [MX] Mexico ..... 190732

[51] Int. Cl.[3] ..... A47B 15/00

[52] U.S. Cl. ..... 248/105; 248/102

[58] Field of Search ..... 248/105, 107, 103, 102, 248/104, 106

[56] References Cited

U.S. PATENT DOCUMENTS

| | | | |
|---|---|---|---|
| 1,151,920 | 8/1915 | Barton | 248/103 |
| 1,322,656 | 11/1919 | Treadwell et al. | 248/107 |
| 1,435,217 | 11/1922 | Davinson | 248/103 |
| 2,496,527 | 2/1950 | Forrest | 248/107 |
| 2,679,995 | 6/1954 | Williams | 248/105 |
| 2,828,097 | 3/1958 | Faunce | 248/106 |
| 2,890,007 | 6/1959 | Rutledge | 248/105 |
| 2,931,608 | 4/1960 | Farah | 248/106 |
| 2,953,338 | 9/1960 | Hodgson | 248/106 |
| 3,539,140 | 11/1970 | Tuttle | 248/104 |

FOREIGN PATENT DOCUMENTS

| | | | |
|---|---|---|---|
| 0143142 | 8/1903 | Fed. Rep. of Germany | 248/102 |

*Primary Examiner*—Ramon S. Britts
*Assistant Examiner*—Ramon O. Ramirez
*Attorney, Agent, or Firm*—McDougall, Hersh & Scott

[57] ABSTRACT

The present invention relates to a nursing bottle support. The object is to sustain the nursing bottle in position to enable the baby to ingest the liquid food contained therein. It consists of a tripod from which two strings hang therefrom to support a wire framework wherein the nursing bottle is positioned.

3 Claims, 2 Drawing Figures

NURSING BOTTLE SUPPORT

INTRODUCTION

The present invention concerns improvements to a nursing bottle support.

DETAILED DESCRIPTION OF THE INVENTION

Figure 1:
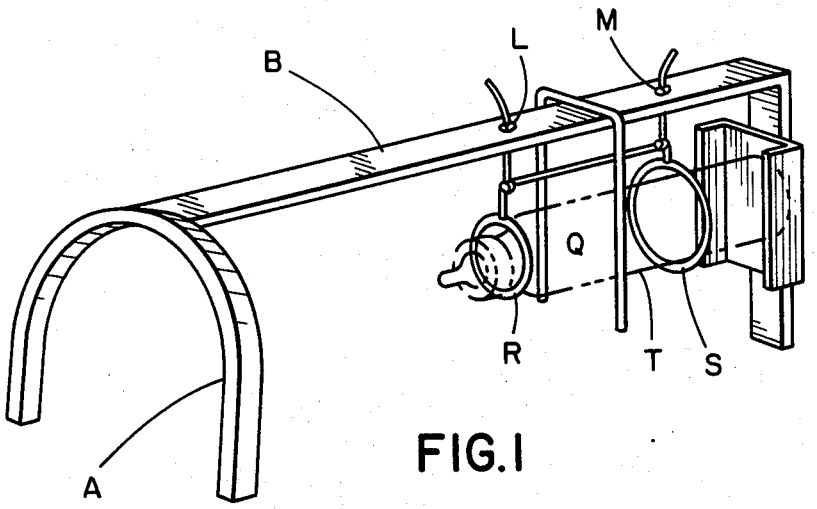
FIG. 1 is a conventional perspective view of the nursing bottle support embodying the features of this invention.
Figure 2:
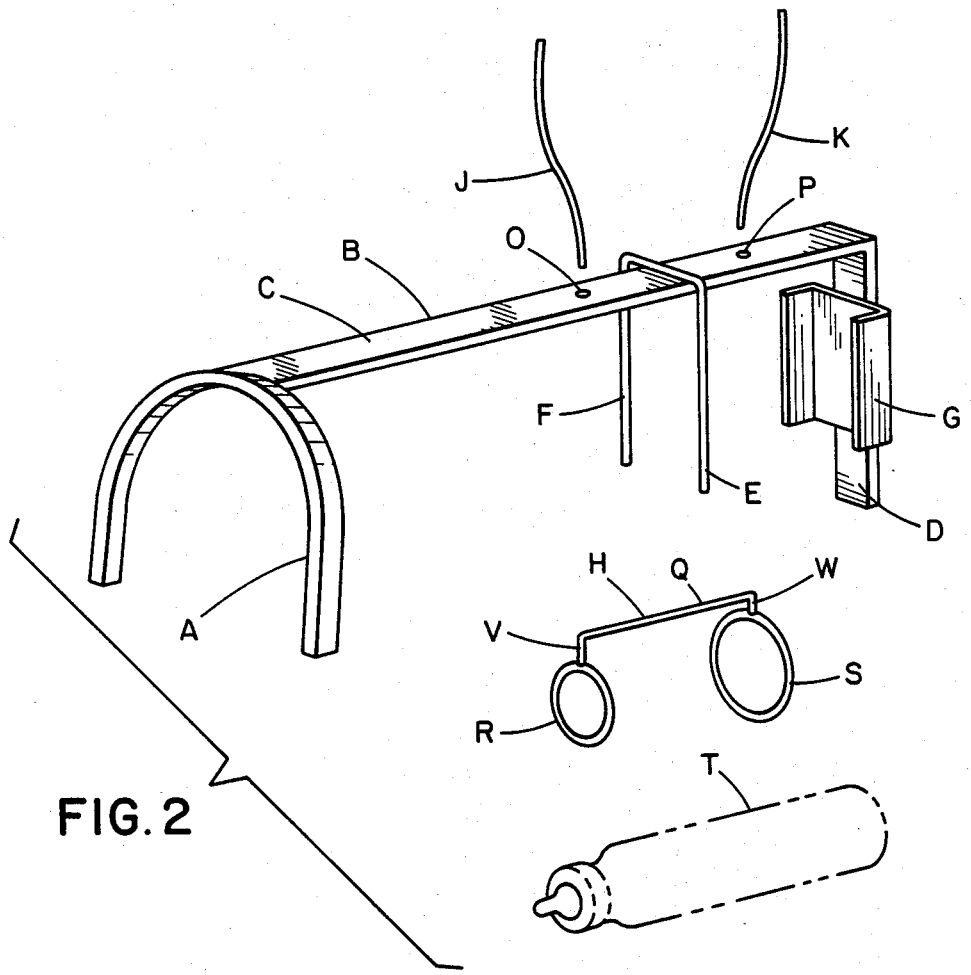
FIG. 2 is a perspective view of the separate elements of the nursing bottle support shown in FIG. 1.

A nursing bottle is illustrated schematically in the drawings by broken lines.

The nursing bottle T support is constituted by a tripod from which hang two strings J and K, and a wire framework wherein the nursing bottle T is positioned.

The tripod is made of metal and is constituted by two rods. One of these is circle-like A and the other is an L-shaped angular rod B. The circle-like rod A is half circle shaped, the concavity thereof being directed downwardly with the ends thereof constituting two of the three tripod legs.

The angular rod B is right angle shaped, one of the sides thereof C being horizontally disposed and the other D vertical.

The horizontal side is about 16 inches long and has two 3/32 inch diameter circular passages O and P therethrough. One of these passages P is located at $1\frac{1}{2}$ inches from the angle peak and the other is located about 6 inches from the peak. These two holes are provided for the passage of the strings M and L supporting the framework.

The horizontal side C, positioned about $3\frac{1}{8}$ inches from the angle peak, has two parallel vertical bars E and F being in a plan perpendicular to the angle plan. Each one of these two parallel bars is 6 inches long and is separated one from the other by about $2\frac{3}{8}$ inches. The upper end portions thereof, parallel bars E and F are bent towards the middle until they reach each other and form a single part. In the bent zone, the parallel bars are welded to the angular rod horizontal side. In the alternative, the vertical bars E and F can be formed of a single strip of metal band to U-shape to provide the depending, laterally spaced apart parallel arms E and F joined by the bail portion which is fixed to the top side of the horizontal side C.

The horizontal side C is secured, as by welding, to the free end to the upper circumferential portion of rod A.

The angular rod vertical side D is 8 inches long and is directed downwardly, constituting the third tripod leg. At $1\frac{5}{8}$ inches from the angle peak, it is provided with a sheet having a base portion which is about $2\frac{3}{8}$ inches wide, and flanged portions about 13/16 inch extending substantially perpendicularly inwardly from the lateral edges in the direction towards the parallel bars E and F. This slot is secured, as by welding, to the angular rod.

The object of the flanged sheet G as well as of the parallel bars E and F is to provide a track or guide for the nursing bottle to slide upwardly or downwardly but not transversally in the point of the nipple.

The nursing bottle T is positioned in the wire framework H. The wire is 16 gauge and is formed of a $4\frac{3}{8}$ inch straight horizontal portion Q and downwardly extending end portions V and W thereof with a ring R and S at each end. One of the rings R is smaller than the other S, and the narrow part of the nursing bottle, that is the neck of the nursing bottle, may be inserted therethrough but not the wide part of the nursing bottle, that is the body of the nursing bottle. The other ring S is slightly larger and the neck as well as the body of the nursing bottle can be introduced therethrough. The two rings are aligned in such a way that the nursing bottle can be introduced in the two rings simultaneously, firstly passing through the larger ring and then through the smaller ring where it is retained; thus the nursing bottle is sustained by the neck on the smaller ring R and by the body on the larger ring S.

The two strings K and J are provided for hanging the wire framework H from the tripod. Each string is 8 inches long and 1/16 inch thick and is tied from one of its ends to each end of the straight wire framework while the upper ends pass through the holes O and P. Both strings have a knot L and M over the two holes to prevent the strings from slipping downwardly. The knots should be tied in the most appropriate places for the purpose of positioning the nursing bottle at an adequate height for enabling the baby easily to suck the liquid food from the bottle.

It will be understood that the shapes and dimensions are given by way of examples and that changes can be made, principally concerning the shape, dimensions and construction material, in accordance with the practical necessities, without departing from the spirit of the invention, especially as defined in the following claims.

I claim:

1. A nursing bottle support comprising a tripod consisting of a bar intended normally to extend in a generally horizontal plane, an arcuate member at one end of said horizontal bar providing two spaced apart legs as a part of said tripod and a vertically extending member at the other end of said bar providing a third leg of said tripod, a pair of spaced holes in said bar adjacent said third leg for receiving a pair of flexible members, a bottle holding support and a pair of flexible members attached to said bottle holding support and extending through said holes, and a U-shaped member extending over said bar and downwardly therefrom to engage the sides of a nursing bottle and limit the movement thereof.

2. A nursing bottle support as set forth in claim 1 wherein said bottle holding support comprises a generally horizontally extending rod to which said flexible members may be attached and a pair of rings at opposite ends thereof for receiving a nursing bottle to be held.

3. A nursing bottle support as set forth in claim 2 including a member having a pair of flanges extending therefrom to limit the movement of a nursing bottle to be received therein.

* * * * *